US007520101B2

(12) United States Patent
Berg et al.

(10) Patent No.: US 7,520,101 B2
(45) Date of Patent: Apr. 21, 2009

(54) ATTACHMENT OF BUILDING ELEMENTS

(76) Inventors: Svein Berg, Einagata 18, Isfjorden (NO) N-6320; Per Jahren, Vakåsveien 79, Hvalstad (NO) N-1395

( * ) Notice: Subject to any disclaimer, the term of this patent is extended or adjusted under 35 U.S.C. 154(b) by 575 days.

(21) Appl. No.: 10/515,014

(22) PCT Filed: Apr. 15, 2003

(86) PCT No.: PCT/NO03/00127

§ 371 (c)(1),
(2), (4) Date: Feb. 8, 2005

(87) PCT Pub. No.: WO03/097952

PCT Pub. Date: Nov. 27, 2003

(65) Prior Publication Data

US 2005/0223659 A1 Oct. 13, 2005

(30) Foreign Application Priority Data

May 22, 2002 (NO) ..... 20022422

(51) Int. Cl.
*E04B 1/38* (2006.01)
*E04C 5/00* (2006.01)

(52) U.S. Cl. ..... 52/706; 52/707; 52/702; 52/253

(58) Field of Classification Search ..... 52/252, 52/253, 706, 707, 702; 403/109.1, 109.8, 403/223

See application file for complete search history.

(56) References Cited

U.S. PATENT DOCUMENTS

| | | | | |
|---|---|---|---|---|
| 1,037,416 | A * | 9/1912 | Beverstock | 52/283 |
| 4,951,438 | A * | 8/1990 | Thoresen | 52/252 |
| 4,959,940 | A * | 10/1990 | Witschi | 52/583.1 |
| 5,218,795 | A * | 6/1993 | Horstketter | 52/125.5 |
| 6,345,473 | B1 * | 2/2002 | Fink et al. | 52/167.1 |
| 6,581,343 | B1 * | 6/2003 | Metelli | 52/223.9 |

FOREIGN PATENT DOCUMENTS

| | | |
|---|---|---|
| CA | 1303379 | 6/1992 |
| DE | 19652115 | 6/1998 |
| EP | 15460 | 9/1980 |
| EP | 423660 | 4/1991 |
| GB | 1400595 | 7/1975 |
| GB | 20277850 | 2/1980 |
| NO | 166963 | 10/1988 |

* cited by examiner

*Primary Examiner*—Richard E Chilcot, Jr.
*Assistant Examiner*—Chi Q Nguyen
(74) *Attorney, Agent, or Firm*—Christian Abel

(57) ABSTRACT

A device for affixing a building element to a supporting element, comprising a guide housing for attachment to the building element or the supporting element. Mounted in the guide housing are at least one movable telescopic member and at least one pull-out cable which is fastened to an attachment point in the telescopic member. The attachment device further comprises at least one return cable fastened to the telescopic member and passed round a winding point to a location for operation of the attachment device or a stop strip for restriction of the extended length of the telescopic member. The attachment device may advantageously be used for affixing concrete elements or affixing staircase elements.

12 Claims, 2 Drawing Sheets

Figure 4:
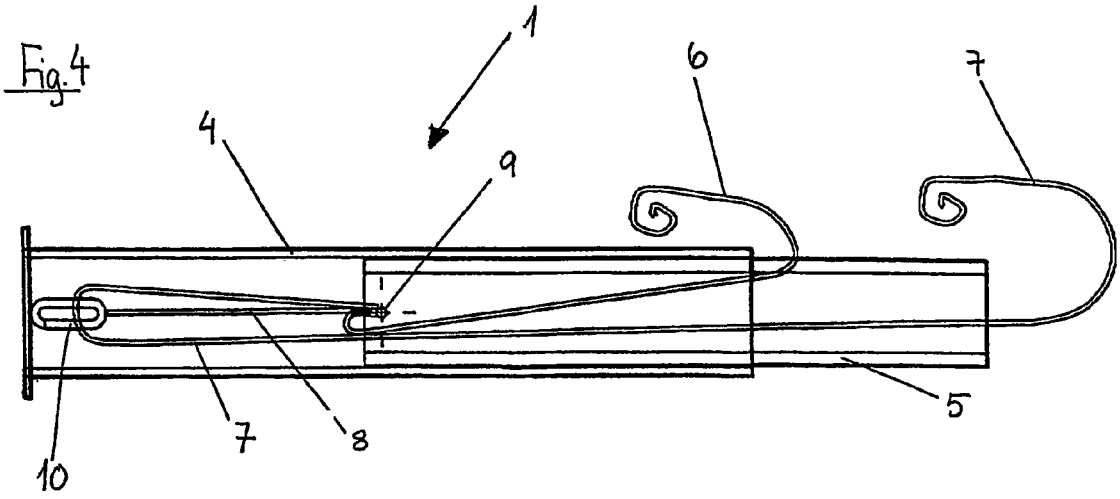

Fig. 1
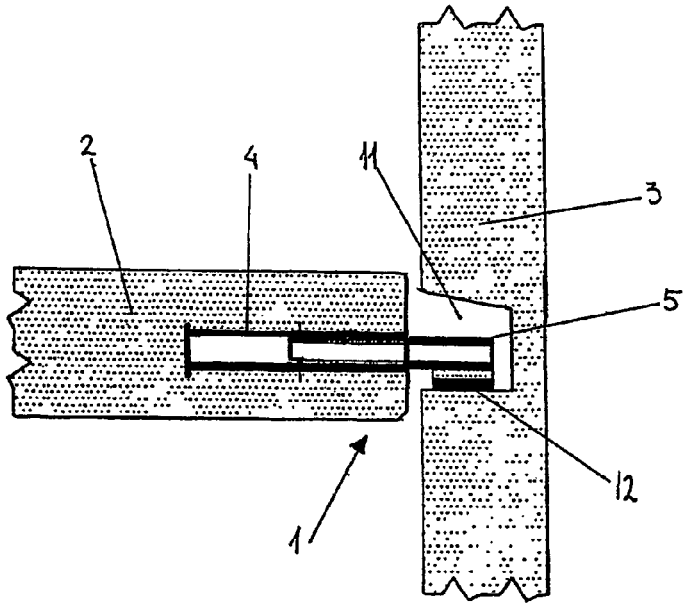
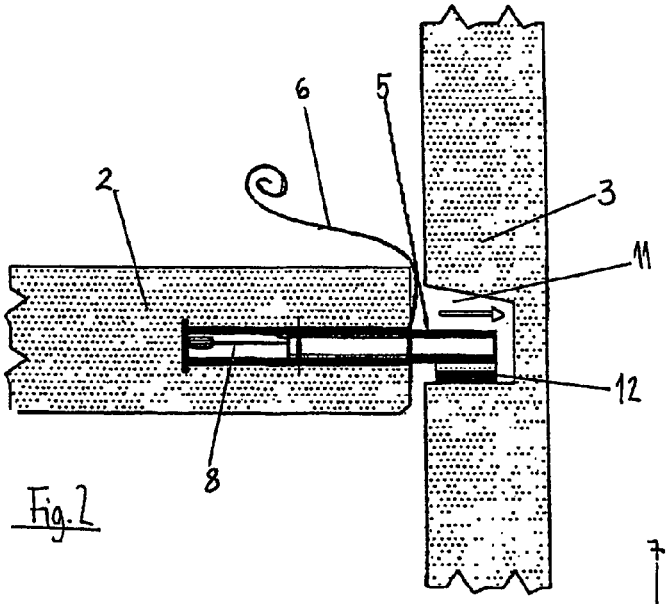
Fig. 2
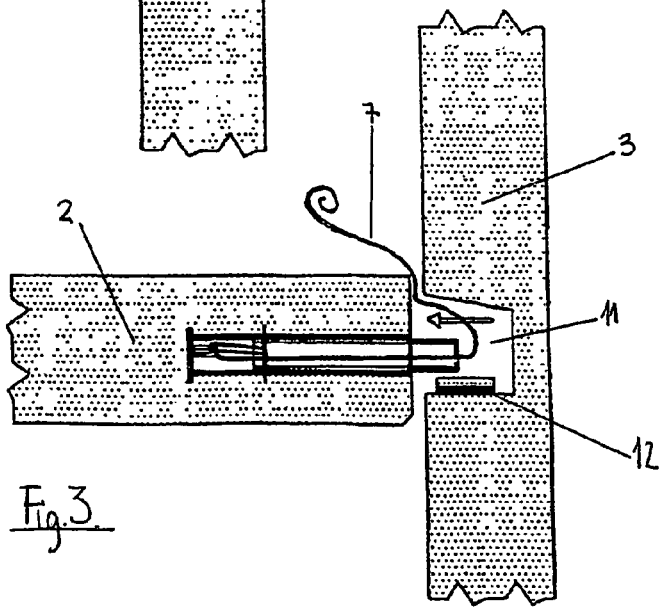
Fig. 3

ATTACHMENT OF BUILDING ELEMENTS

BACKGROUND OF THE INVENTION

The invention relates to an attachment device for affixing a building element to a supporting element and the use thereof. The attachment device comprises a guide housing for attaching to the building element, where at least one movable telescopic member and at least one pull-out cable are mounted in the guide housing.

The need often arises for affixing a heavier building element to a supporting element, be it for affixing concrete floor elements and/or wall elements, landings or staircase elements. In many of these instances there is little clearance between the building element and the supporting element, and in many cases it is desirable to have a concealed attachment. It is therefore desirable to have an attachment device that can be operated at a distance from the actual attachment point. At the same time an attachment device is required which is of a simple design and therefore reliable, stable and easy to use.

From the prior art the use is known of an attachment device consisting of a guide housing attached to the building element, with a telescopic member in the guide housing and a pull-out cable. During installation the telescopic member is pulled out of the guide housing by tightening the pull-out cable, thus causing the telescopic member to come into engagement with a notch in the supporting structure. Other examples of the prior art regarding attachment devices for affixing a building element to a supporting element are disclosed in patent publications NO 1666963, DE 19652115 and EP 0015460.

There are some problems associated with these solutions. In order to achieve a reliable and stable attachment, the telescopic member should not be pulled too far out of the guide housing. No solution is indicated in the event that the telescopic member has been pulled out too far or where there is a need to remove the building element from engagement with the supporting element during attachment.

SUMMARY OF THE INVENTION

The object of the present invention is to provide a device for affixing building elements to supporting elements, which avoids the above-mentioned problems and where the attachment device provides a simple, reliable and stable attachment of the building element.

It is also an object of the invention to indicate preferred applications of the attachment device.

The object is achieved with an attachment device as indicated in the independent claims and where additional features of the invention are indicated in subsequent claims.

The attachment device according to the invention comprises a guide housing. The guide housing has at least one open end and is attached to the building element that has to be affixed to the supporting element. Depending on the use of the attachment device, the guide housing may be located in a concealed position inside a recess in the building element, or alternatively on the top or bottom of the building element. The guide housing may also have any suitable shape and cross section, where it provides guidance and necessary support for a telescopic member. Mounted in the guide housing is at least one telescopic member, which is movable from a position substantially inside the guide housing to an extended position where a part of the telescopic member is pulled out through the guide housing's open end. The telescopic member and the guide housing may have complementary shapes. They may also be envisaged with different shapes and cross sections, the cross section of the guide housing being square, while the telescopic member is triangular. What is required is that the telescopic member and guide housing together provide the strength that is necessary for affixing the building element. The telescopic member and guide housing may be equipped with devices to facilitate sliding between the parts, which for example may be coated with a sliding coating or have roller or ball bearings arranged between the parts to facilitate relative movement between the parts. The telescopic member has an internal and an external end, where during attachment the external end affixes the attachment device to the supporting element or vice versa. The attachment device also has a pull-out cable, which is fastened to an attachment point on the telescopic member. The cable is passed from the attachment point in such a manner that when an operator pulls the cable, the telescopic member will be moved to an extended position relative to the guide housing, and the building element is affixed to a supporting element.

According to an embodiment of the invention the attachment device further comprises at least one return cable. The return cable is fastened to the telescopic member, for example at the attachment point, from which it extends round a winding point, with the result that when an operator pulls the return cable the telescopic member will be retracted into the guide housing. It will be natural to place the winding point on the guide housing or building element. This makes it possible to ensure correct extension of the telescopic member in order to achieve a reliable and stable attachment of the building element. It also makes it possible to pull the building element and the supporting element apart again during attachment if this should be necessary.

In a second embodiment of the invention the attachment device further comprises at least one stop element. This stop element is in the form of a stop strip attached between the telescopic member and the guide housing. The stop strip has a length that ensures that the telescopic member is not overloaded by preventing it from being pulled out too far from the guide housing and thereby ensuring a reliable and stable attachment of the building element.

The invention also relates to the use of the attachment device according to the invention. The attachment device may advantageously be employed when affixing concrete elements to a wall or a pillar. In this case the attachment device may be concealed or visible. The attachment device according to the invention may advantageously be employed for concealed attachment of staircase elements to the wall of the staircase. The attachment device may also be used between several staircase elements, for example landing and tread elements. Even though these are preferred applications, a number of other areas may be envisaged where the attachment device according to the invention may be used, e.g. where a concealed attachment is required in order to make the attachment more attractive, to avoid vandalism, etc.

A BRIEF DESCRIPTION OF THE DRAWINGS

Figure 5:
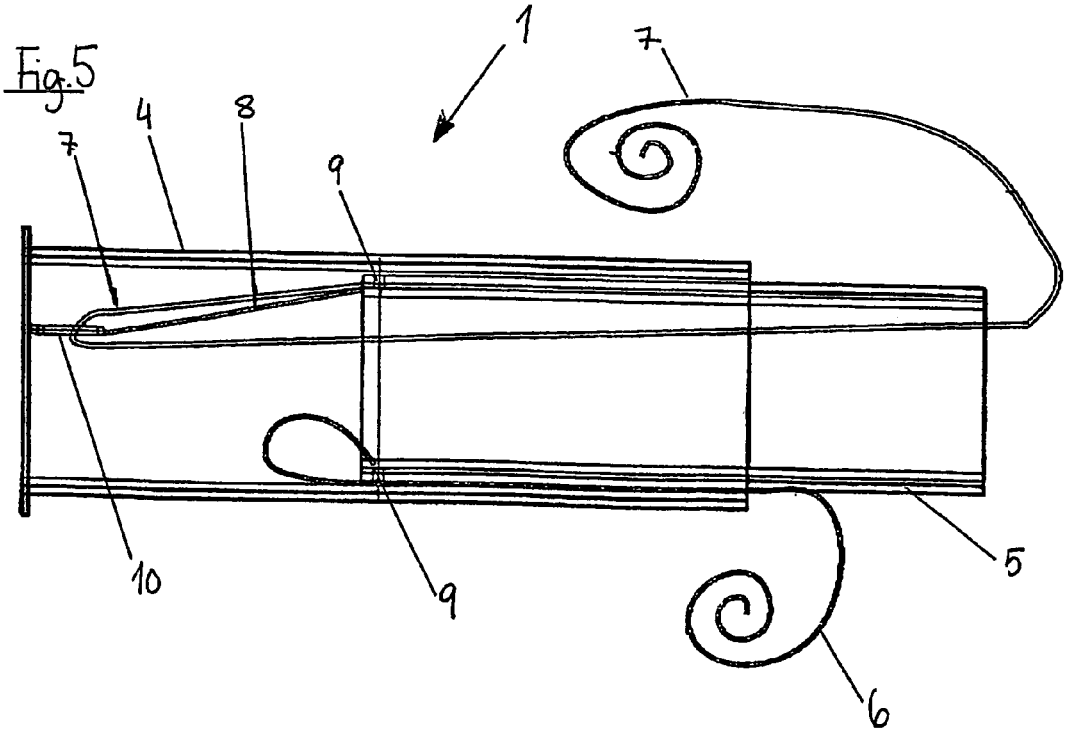

The invention will now be explained by means of an embodiment, with references to the drawings, in which:

FIG. 1 is a principle drawing where a building element is affixed in a concealed manner to a supporting element, FIG. 2 is a principle drawing for the attachment of a building element with an attachment device according to the invention, FIG. 3 is a principle drawing for adjusting the telescopic member in the attachment device according to the invention, FIG. 4 is a principle drawing of the attachment device according to the invention viewed from the side, FIG. 5 illustrates the device in FIG. 4 viewed from above.

DETAILED DESCRIPTION OF THE INVENTION

Attachment device 1 according to the invention is intended to affix a building element 2 to a supporting element 3. In many cases the building element will be a concrete element of different types and supporting element 3 a wall or pillar, where the attachment has to be made to a point on the wall and/or the pillar and the area between the building element and the supporting element is a tight fit, such as, for example, a staircase.

As illustrated in FIG. 1 the attachment device 1 comprises a guide housing 4 which is attached to the building element 2. The guide housing has at least one open end, but otherwise may be of any suitable shape. It may, for example, be open at both ends. As illustrated in FIGS. 1-3 the guide housing 4 is located in a recess in the building element 2. The guide housing may also be envisaged located on the bottom or the top of the building element 2. It is also possible for the guide housing to be mounted in a recess in the supporting element.

A telescopic member 5 is mounted in the guide housing 4. The telescopic member 5 can be moved from a position wherein it is substantially located inside the guide housing 4 to an extended position for affixing the building element 2 to the supporting element 3, as illustrated in FIG. 1. The telescopic member 5 has an internal and an external end. During attachment of the building element 3, the external end will be located in a recess 11 in the supporting element, as illustrated in FIG. 1. With stairs, for example, when attaching the building element a packing 12 will be placed between the telescopic member's external end and the recess in the supporting element. This is done in order to isolate the building element from the supporting element, thus preventing the transmission of, for example, sound from the building element to the supporting element.

As illustrated in FIGS. 4 and 5, in an embodiment the attachment device comprises a pull-out cable 6. The pull-out cable 6 is fastened to an attachment point in the telescopic member 5. It is further conveyed in such a manner that it moves the telescopic member 5 out of the guide housing 4 when the pull-out cable 6 is tightened by an operator. In the embodiment, the attachment point 9 is located at the internal end of the telescopic member 5, and the pull-out cable 6 is passed from the attachment point 9 between the telescopic member 5 and the guide tube 4 to the outside of the attachment device 1, thus enabling an operator to tighten the pull-out cable 6. The attachment point 9 may also be envisaged located at other points on the telescopic member, but where the passage of the cable gives the desired extension of the telescopic member.

The attachment device 1 further comprises a return cable 7. The return cable 7 is fastened to the telescopic member and passed over a winding point out to the operator. FIG. 4 illustrates how the return cable is fastened in the same way as the pull-out cable to the telescopic member at its internal end. In the embodiment, the winding point comprises a closed hook, through which the return cable is passed. This hook may be an open hook. The hook is attached to the end of the guide housing 4 which is opposite the open end. On tightening the return cable, the telescopic member will be moved into the guide housing. This may be appropriate where the telescopic member has been pulled out too far or where it is necessary to release the building element 2 from the supporting element 3. The return cable 7 may be fastened to the telescopic member 5 at several points and may be wound around several alternative points and still achieve the same effect. The return cable 7 may also be wound in several internal loops in the attachment device 1 in order to achieve a desired relationship between tightening of the return cable 7 and movement of the telescopic member 5. The same procedure may also be followed for the pull-out cable 6.

As illustrated in FIGS. 4 and 5, the attachment device 1 further comprises a stop strip 8. The stop strip is attached between the telescopic member 5 and the guide housing 4, in the embodiment at the attachment point 9 and the winding point 10. The function of the stop strip is to prevent the telescopic member 5 from being pulled out too far from the guide housing 4. It is the length of the stop strip 8 that is the limiting factor for the telescopic member's 5 extended position.

The attachment device's 1 telescopic member 5 may also have external markings to indicate the length to which the telescopic member 5 has been pulled out and, for example, a wide ring to indicate the maximum length to which the telescopic member 5 can be pulled out. This provides a double security against overloading of the attachment device's telescopic member.

In FIG. 2 a building element 2 with attachment device 1 is illustrated, where the telescopic member 5 is pulled out by means of a pull-out cable 6, as illustrated by an arrow in the figure, for engagement with the recess 11 in the supporting element 3.

In FIG. 3 a building element 2 with an attachment device 1 is illustrated, where the telescopic member 5 has been slightly retracted from an external extended position by means of a return cable 7.

The invention has been described in the above by means of embodiments. In addition to the embodiments a number of variants and modifications of the invention may be envisaged which fall within the scope of the invention as it is defined in the following claims. The attachment device's guide housing, for example, may be composed of the actual recess in the building element. The guide housing may consist of truncated tubes which are open at both ends, or other more open framework structures. Attachment of the winding point for the return cable may be made on a side wall of the guide housing or on the actual building element. If the guide housing is not mounted internally in the building element, but on the top or bottom thereof, the pull-out and return cables may be conveyed in a different way to that indicated in the embodiment and still achieve the same effect. For example, the return cable may be passed backwards from the telescopic member and out of the end of the guide housing opposite the open end. The attachment of the pull-out and return cables is indicated in the embodiment at the inside of the telescopic member, but this may also be at the outside or the end of the telescopic member. In the case of a closed telescopic member, the end surface may be an alternative attachment location. The pull-out and return cables may be cables, lines, chains, or other suitable elongated elements. They may be designed in different colours or shapes to enable the operator to distinguish between the pull-out cable and the return cable. On being affixed to a supporting element, a building element will usually have several attachment devices according to the invention. A collective arrangement may therefore be envisaged for the pull-out and return cables for several attachment devices for a building element. The attachment device is explained by an embodiment where it is attached to the building element. This may also be envisaged performed in the opposite manner, where the attachment device is attached in a recess in the wall and the telescopic member for attaching the building element is inserted in a recess therein.

What is claimed is:

1. An attachment device for affixing a building element to a supporting element, comprising a guide housing attached to either the building element or the supporting element, said guide housing comprising at least one movable telescopic member with at least one pull-out cable fastened to an attachment point in the telescopic member, said pull-out cable being arranged for pulling the telescopic member partly out of the guide housing and into engagement with the other element, where the pull-out cable is passed from the attachment point to a location for operation of the attachment device, wherein the attachment device further comprises at least one return cable attached to the telescopic member for returning the telescopic member back into said guide housing said return cable being passed around a winding point at an inner end of the guide housing to a location for operation of the attachment device.

2. The attachment device according to claim 1, further comprising a stop element for restricting overextension of the telescopic member relative to the guide housing.

3. The attachment device according to claim 2, wherein the stop element consists of a stop strip fastened between the attachment point and the winding point.

4. The attachment device according to claim 1, wherein the telescopic member has a marking on its outside for indicating extended length with indication of maximum extended length.

5. The attachment device according to claim 4, wherein the attachment device's guide housing is attached in a recess in the building element.

6. The attachment device according to claim 5, wherein the telescopic member, when extended, engages a recess in the supporting element.

7. An attachment device for affixing a building element to a supporting element, comprising a guide housing attached to the building element, said guide housing comprising at least one movable telescopic member arranged for telescopic engagement with the supporting element, the device comprising at least one pull-out cable fastened to an attachment point in the telescopic member, wherein the pull-out cable is passed from an attachment point to a location for operation of the attachment device, wherein the attachment device further comprises at least one stop element in the form of a stop strip fastened between the telescopic member and the guide housing.

8. The attachment device according to claim 7, wherein the attachment device further comprises at least one return cable fastened to the attachment point and passed round a winding point to a location for operation of the attachment device.

9. A method for attaching a building element to a support element, comprising steps of providing an attachment device according to claim 4, wherein the telescopic member is initially retracted inside the guide housing (4), positioning the building element such that the telescopic member is adjacent to an attachment point on the support element, and manipulating pull-out cable such that telescopic member is moved to an extended position and engages the attachment point.

10. The method according to claim 9, wherein, in order to release the building element from the support element a return cable is manipulated to return to the telescopic member to the retracted position.

11. The method according to claim 9, wherein the attachment point is a recess.

12. The method according to claim 11, further comprising providing a gasket or other resilient material between the telescopic member and the attachment point.

* * * * *